United States Patent [19]

Cohen

[11] Patent Number: 4,626,200

[45] Date of Patent: Dec. 2, 1986

[54] SHAFT KILNS HAVING FLUID-BED AIR HEATER

[75] Inventor: Sidney M. Cohen, Allentown, Pa.

[73] Assignee: Fuller Company, Bethlehem, Pa.

[21] Appl. No.: 755,124

[22] Filed: Jul. 15, 1985

[51] Int. Cl.[4] ..... F27D 1/08

[52] U.S. Cl. ..... 432/101; 432/96

[58] Field of Search ..... 432/5, 13, 95, 99, 96, 432/101; 60/39.464; 110/216

[56] References Cited

U.S. PATENT DOCUMENTS

| | | | |
|---|---|---|---|
| 1,805,151 | 5/1931 | Reed | 432/101 X |
| 4,021,184 | 5/1977 | Priestley | 110/216 X |
| 4,080,784 | 3/1978 | Jubb | 60/39.464 X |
| 4,431,407 | 2/1984 | Beckenbach et al. | 432/99 |
| 4,473,352 | 9/1984 | Sonoda et al. | 432/96 |
| 4,498,286 | 2/1985 | Brannstrom et al. | 60/39.464 X |
| 4,530,207 | 7/1985 | Brannstrom et al. | 60/39.464 |

*Primary Examiner*—Edward G. Favors

*Attorney, Agent, or Firm*—Frank H. Thomson

[57] ABSTRACT

The invention utilizes fluid bed air heaters for burning coarse solid fuels which supply heated gases to annular shaft kilns or double inclined shaft kilns. The solid fuels are introduced into a fluidized bed of inert material, such as sand, alumina or ash, through means of an air lock and the hot gases of combustion pass through a cyclone separator to remove solid materials, which can be reintroduced into the fluidized bed. The hot gases are injected into the kilns to supply heat as needed for calcining or burning limestone or similar materials. Temperature control of the gas leaving the fluid bed air heater and reduced contamination of the burned materials are disclosed advantages of the present invention.

5 Claims, 3 Drawing Figures

SHAFT KILNS HAVING FLUID-BED AIR HEATER

BACKGROUND OF THE INVENTION

1. Field of the Invention

The role of shaft kilns for calcining limestone and the like is well known in the prior art. Such kilns in the prior art are known as "annular shaft Kilns" or "double inclined kilns". At present, most all double inclined shaft kilns in operation, utilize gaseous fuels as a means of firing the systems. The few exceptions utilize a coal stoker to generate hot gases for such systems. The problems associated with the coal stoker kilns of the prior art include contamination from the solid fuel injected directly into the system, high capital cost for the stoker arrangement, increased power consumption of prior art systems in the necessity to pulverize the solid fuel utilized, the narrow and specific type of solid fuel material suitable for use in the prior art systems, and the lack of temperature control in the coal stoker systems of the prior art. In addition, annular shaft kilns are also fired only with gaseous fuels and experimental work on direct injection of pulverized coal into such units in order to accommodate the less expensive fuel has created the problem of ash contamination and sulfur absorption, particularly when producing lime or dolomite for use in the steel industry.

The invention defined herein is concerned with an improved apparatus and sequence of processing steps which will more efficiently utilize the capabilities of shaft kilns of the annular and double inclined type.

2. Description of the Prior Art

Kilns known as "annular shaft kilns" or "double inclined kilns" are generally known in the prior art and are illustrated and described in one or more of the following U.S. Pat. Nos. 3,204,936; 3,658,308; 3,695,595; 3,765,827; 3,856,436; 4,025,293; and 4,254,221, the disclosures of all of which are incorporated herein by reference.

SUMMARY OF THE INVENTION

The instant invention is an apparatus for the burning of limestone, dolomite, magnesite, cement and ores or the like, comprising a generally vertical hollow structure having an inlet at an upper end thereof and a discharge site at the lower end thereof; a substantially enclosed shaft connecting said inlet and said discharge site; said shaft including a vertical conduit descending from said inlet and terminating at an inclined surface definining one surface of a first enlarged chamber; said chamber having an outlet comprising a generally vertically descending conduit terminating at a second inclined surface defining one surface of a second enlarged chamber; said first and second chambers each shaped so as to define a free space when filled with limestone or the like, wherein hot gases can be injected into each of said spaces; said second chamber having an outlet comprising a substantially vertically descending conduit connected to said discharge site; the improvement comprising a fluidized bed air heater for supplying hot gases to be injected in each of said first and second chambers; said fluidized bed comprising an inert bed of fluidized materials; means for supplying solid fuel to said fluidized bed for combustion within the fluidized bed for generating hot gases; an outlet for hot gases; and conduits connecting said outlet for hot gases to each of said first and second chambers.

The invention also comprises a fluidized bed air heater for supplying hot gases to be injected at each of a first and second chamber in a double inclined shaft kiln; said fluidized bed comprising an inert bed of fluidized material; an air lock through which solid fuel may be fed to said fluidized bed; an outlet for hot gases; and conduits connecting said outlet for hot gases to each of said first and second chambers.

The invention also comprises an annular shaft kiln for the burning of limestone or the like, comprising a generally vertical hollow structure having an inlet at an upper end thereof and a discharge site at the lower end thereof; an enclosed shaft connecting said inlet and said discharge site; an inner cylinder disposed within said generally vertical shaft so as to define a generally annular zone between said inlet and said discharge site, and further comprising at least one chamber in said annular zone for the introduction of hot gases to said zone; the improvement comprising a fluidized bed air heater for supplying said hot gases to be injected into each of said chambers; said fluidized bed comprising an inert bed of fluidized material; means for supplying solid fuel to said fluidized bed for combustion therein to produce hot gases; an outlet for hot gases; and conduits connecting said outlet for hot gases to each of said chambers.

DESCRIPTION OF THE PREFERRED EMBODIMENTS

As has heretofore been stated, the novel apparatus and process of this invention is concerned with the utilization of solid fuel for supplying heat to either an annular shaft kiln or a double inclined kiln without the disadvantages attendant in the utilization of solid fuel employed in coal stoker apparatus.

The fluid bed unit of the present invention can use as a fuel coarse coal 1"×0, which can be gravity fed through an air lock into an inert bed of fluidized material, such as ash, sand or alumina. The coarse portion of the ash generated from the fuel is maintained in the bed. The fine fraction carried out with the hot gases can be separated in a hot cyclone and returned to the bed area. Eventually the bed material, with the bulk of its fines, can be withdrawn, such as by periodic overflow, out through an overflow pipe to a disposal bin. The fluid bed unit of the present invention can be utilized with existing annular shaft kilns or double inclined kilns with minor modification, or may be incorporated into the design of new units. The fluid bed unit of the present invention can be used to burn almost any quality solid fuel material, regardless of its volatile content, and does not produce the contamination found when totally solid fuel is injected directly into the kiln. Additionally, temperature control of the hot gas leaving the fluid bed air heater can be more precisely controlled by the use of dampers in the system of conduits leading to the chambers into which the heated air is to be injected.

Annular shaft kilns of prior art systems are presently fired by multiple burners at different levels, typically at two different levels. The number of burners used at each level is determined by the unit's overall capacity, typically as shown in the following Table:

TABLE 1

| Capacity MT/Day | |
|---|---|
| 50–150 | 3 burners at each level - 6 total |
| 150–300 | 4 burners at each level - 8 total |
| 300–450 | 5 burners at each level - 10 total |

TABLE 1-continued

| Capacity MT/Day | |
|---|---|
| 450–600 | 6 burners at each level - 12 total |

These prior art burners use gas or oil as fuels and have a combustion chamber at each location, incurring increased capital and maintenance costs. The present invention utilizes one fluid bed air heater at each of these levels. Each fluid bed has multiple conduits for injecting hot gas into the shaft kiln at each location where existing burners were used in the prior art.

The hot gas produced by the present invention will be injected at a temperature of 50°–100° C. below the ash fusion of the fuel being used. This avoids possible ash fusion buildup. In the case of most coal, this temperature is usually around 1150° C. A small amount of pulverized coal or gas or oil can be used for final temperature control by injecting the same as needed at each injection point in the kiln to give a normal control temperature of about 1250° C.

The solid fuel burned in the fluid bed air heater can supply the total heat to the kiln, but typically will supply 80–90% of the total heat requirement. The remainder of the heat can be obtained by a small amount of injected pulverized solid fuel if 100% solid fuel is desired, or by small amounts of gas or oil if further contamination control is required. These injection points are at the typical locations found in the prior art systems.

Of course, the fluid bed air heater of the present invention can be added to existing installations with minimum space requirement or designed into a completely new system.

BRIEF DESCRIPTION OF THE DRAWINGS

The invention will be better understood with reference to the examples which follow and with reference to the following figures, in which.

DESCRIPTION OF THE INVENTION

Figure 1:
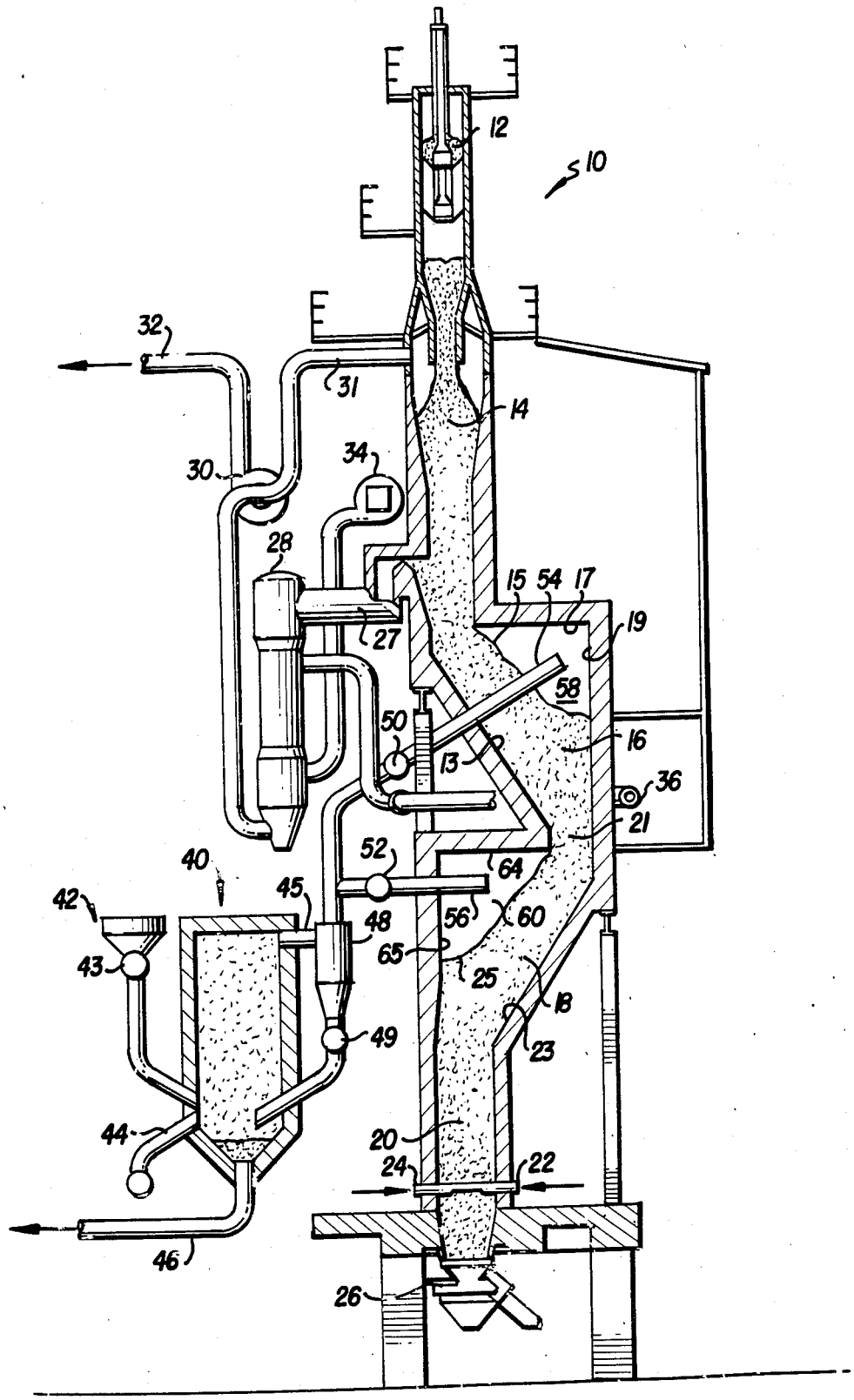
FIG. 1 is a schematic representation of a double inclined shaft kiln with the fluid bed air heater of the present invention.

Referring now to the drawings, a double inclined shaft kiln is shown generally at 10 in FIG. 1. Limestone or other material to be burned, such as cements or ores, are fed in through inlet 12 at the upper end of the kiln. As the feed material descends, it is preheated in preheating zone 14 by rising hot gases. The material descends until it contacts inclined surface 13. This inclined surface 13 tends to deflect the particles so as to form a boundary layer 15, as illustrated. This boundary layer 15, together with the walls 17 and 19 of the kiln form a first chamber creating a space 58, into which hot gases may be introduced by means of conduit 54. These hot gases calcine or burn the limestone or other material in the first of two calcining zones. As the limestone or other material descends from this first chamber through conduit 21, it contacts a second inclined wall portion 23, which again changes the direction of flow of the particles. These particles form a new boundary layer 25 which, together with the walls of this second chamber, form space 60 into which conduit 56 injects further hot gases. These hot gases calcine or burn the limestone or other material in a second calcining zone 18. The burned material is then permitted to descend through conduit 20 to hydraulic discharge apparatus 26. Cooling air is permitted to enter the kiln at inlets 22 and 24 so as to cool the burned material as it descends through conduit 20. Heat recuperator 28 draws off hot gases from the kiln through conduit 27 by means of fan 30. These hot gases may be recycled to form preheated burner air through conduit 36. Burner air fan 34 cooperates with heat recuperator 28 to recycle excess heat from the kiln in the form of preheat for the burner of the present invention. Additional heat may be drawn off through conduit 31 above the preheat zone 14 by exhaust fan 30, and particles contained in the air stream may be passed to a dust collector through conduit 32 for ultimate separation and disposal.

In summary, the double inclined kiln of FIG. 1 includes a generally vertical hollow structure 10 having an inlet 12 at its upper end and a discharge site or outlet 26 for burned material at its lower end. A substantially enclosed shaft connects the inlet and the discharge site. This enclosed shaft includes a vertical conduit 14 descending from the inlet 12 and terminating at an inclined surface 13 and defining one surface of a first enlarged chamber or calcining zone 16. Walls 17 and 19 define the other surfaces of chamber 58. The chamber 58 has an outlet 21 which is a generally vertically descending conduit terminating at a second inclined surface 23. This, in turn, defines one surface of a second enlarged chamber 60. Walls 64 and 65 define the other surfaces of the chamber or calcining zone 18. The first and second chambers 16 and 18, respectively, are each shaped so as to define a free space 58 and 60, respectively, when filled with material to be burned. Hot gases can be injected to each of these spaces as by means of conduits 54 and 56 respectively. The second chamber 18 has an outlet 20 which is a substantially vertically descending conduit connected to the discharge site at 26.

The fluid bed air heater of the present invention is shown generally at 40, wherein coarse fuel material, such as coarse coal, peat or other solid fuel, may be fed through inlet hopper 42 by means of air lock 43 into the fluid bed system. The fluid bed itself is comprised of particles of inert material, such as sand, ash or alumina, which are kept in suspension by means of air or other gas injected through conduit 44. This air or other gas may typically be preheated by the excess heat recovered from the kiln through conduits 31 or 27, or by other means. As previously described, excess heat can be extracted, such as by means of recuperator 28, so as to preheat the inlet air or gas coming through conduit 44. As previously mentioned, the coarse fuel fed into inlet hopper 42 and then through air lock 43 is not limited to only coal or peat, but can comprise a great variety of solid fuels, such as wood chips, sawdust, rice hulks, cow chips, etc. The fuel ignites within fluidized bed 40 and the hot gases generated by combustion of said fuel exit at conduit 45 into cyclone separator 48. The cyclone 48 separates solid particles, such as ash, from the hot gases and delivers these particles through air lock 49 back to the fluidized bed to become a part thereof. Occasionally, ash buildup in fluidized bed will require an occasional draw-off of ash and other bed particles through conduit 46. The hot gases separated in cylcone 48 pass into conduits 54 and 56 where they are injected into chamber 58 and 60 to calcine or burn the material therein. The relative amount of gases introduced through these conduits can be adjusted by means of dampers 50 and 52. By adjusting the volume flow of hot gases to each of these chambers by means of these dampers, the amount of heat and thus the temperatures in each chamber may also be adjusted. If necessary, provision may be made for injecting small amounts of solid, liquid or gaseous fuels into the kiln through openings (not shown) in order to precisely control the temperature within the kiln. If desired, the fluid bed device may include a gas permeable grid dividing the vessel 40 into an upper material chamber and a lower plenum chamber. Fluidizing gas is then supplied to the lower plenum through conduit 44 for passage through the gas permeable grid. The ash may then be drawn off by displacement through an overflow outlet.

Figure 2:
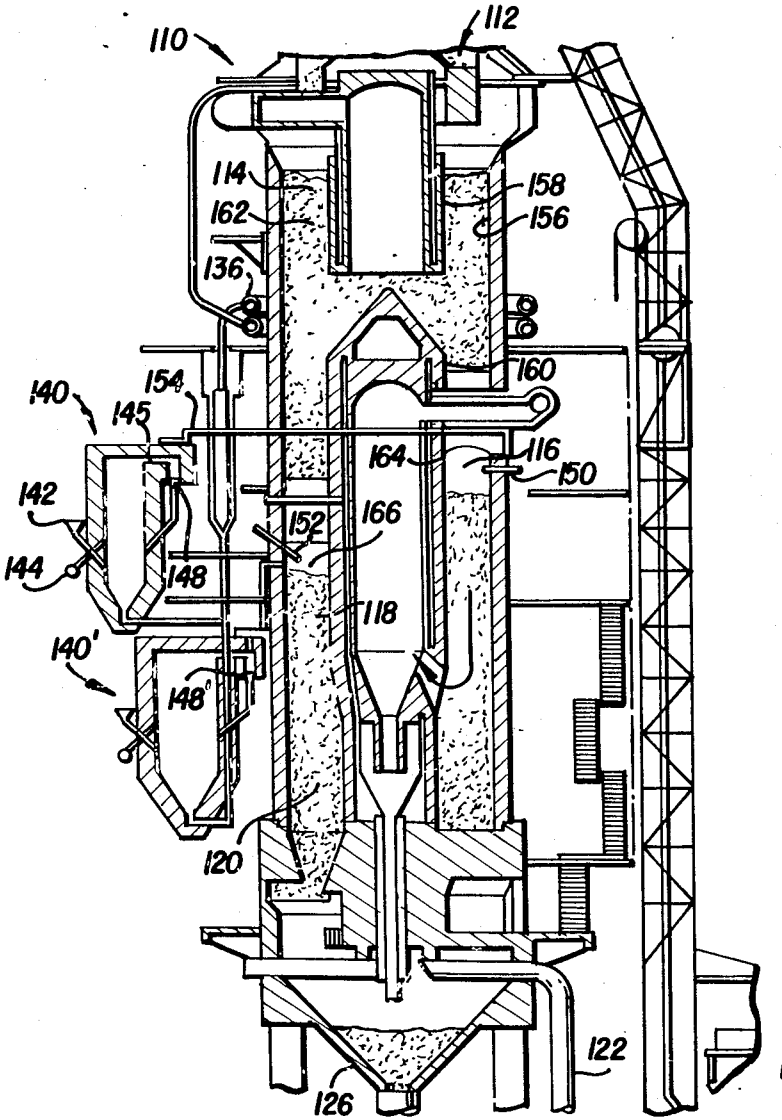
FIG. 2 is a cross-sectional view through an annular shaft kiln utilizing one fluid bed heater at each of two locations.

Turning now to FIG. 2, there is illustrated an improved annular shaft kiln, shown generally at 110. Annular shaft kilns are generally well known in the prior art and complete description of the same is unnecessary here. However, in summary, limestone or other material to be burned enters the annular shaft kiln 110 at inlet 112 located in the upper end of the hollow structure defined by a generally vertically cylindrical shaft 156. The material descends through a preheating zone 114 to a first burning zone 116. As can be seen in the drawings, a bifurcated inner cylinder 158, 160 is disposed within the vertical shaft to define a generally annular zone 162 between the inlet 112 and the discharge site 126. At the first burning zone 116, prior art annular shaft kilns utilized a plurality of burners (not shown) to inject fuel therein. However, the present invention utilizes a fluidized bed air heater, shown generally at 140, in place of the burners previously utilized at the first calcining zone 116. The heated air from the fluidized bed air heater 140 is injected into chamber 164 at zone 116. As the particulate material further descends through the annular shaft kiln, it is burned at a second calcining zone 118 in which hot gases are injected from fluid bed air heater 140' into a second chamber 166. The burned particles further descend through cooling zone 120 for ultimate discharge at hydraulic discharge mechanism 126 at the discharge site in the lower end of the structure. Conduit 122 brings cooling air into the lower end of the annular shaft kiln, thereby providing cooling at zone 120.

Turning now more particularly to describe the fluid bed air heaters 140, 140' in greater detail, there can be seen means for supplying solid fuel such as inlet hopper 142 in air heater 140 through which the solid fuel, such as coarse coal, passes through means of an air lock (not shown) into the fluid bed heater, in a manner similar to that shown with regard to FIG. 1. It will be understood that the solid fuel utilized in each of the fluid bed heaters 40, 140, 140' may be in other forms, i.e., it may be in lump or ground form. Fluidizing air or gas which may be preheated enters through conduit 144 so as to maintain the bed, which may be comprised of inert particles of ash, alumina or sand in a fluidized condition. The solid fuel, which may be any of these fuels utilized in the fluid bed heater 40 of FIG. 1, ignites and generates hot gases which exit through conduit 145 into cyclone separator 148. In a manner similar to cyclone 48, as illustrated in FIG. 1, the solid particles separated by the cyclone separator 148 can be fed through air lock (not shown) back to the fluidized bed. The hot gases exiting the cyclone separator 148 are fed by means of conduit 154 to chamber 164 to burn the limestone or other material in a first calcining zone 116. Additionally, excess heat may be recovered from the annular shaft kiln, as by means 136, which excess heat may be fed to the inlets of each of fluid bed air heaters 140 and 140'. Fluid bed air heater 140' and its related equipment, e.g., cyclone 148', operate in the same manner as the corresponding equipment of fluid bed air heater 140 and duplication of its structure and their manner of operation will be evident to one having ordinary skill in the art in view of the foregoing description, and need not be repeated herein. Additional solid fuel may be directly injected into the annular shaft kilns through conduits 150 and 152 into chambers 164 and 166, respectively, to provide additional heat to precisely control the temperature in each of the calcining zones 116 and 118, as needed.

Figure 3:
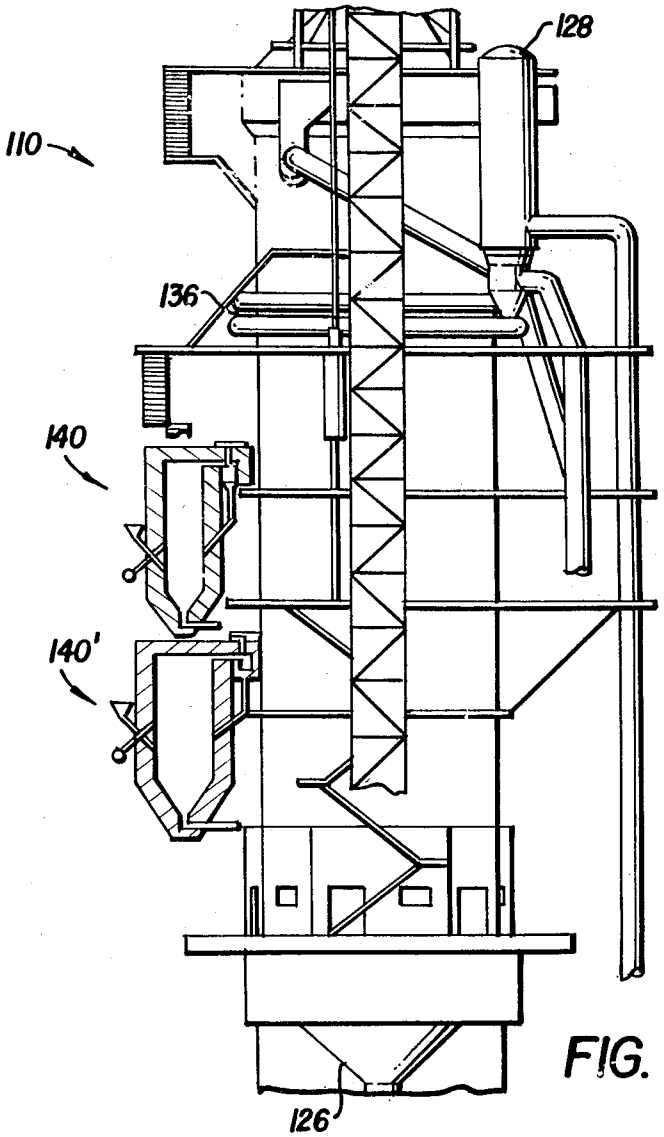
FIG. 3 is a front view of the fluid bed air heater arrangement for an annular shaft kiln or 400 MTD capacity for burning lime, as is shown in FIG. 2.

Turning now to FIG. 3, which is a front view of the annular shaft kiln of FIG. 2 and generally depicted at 110, it can be seen that a heat recuperator 128 may be utilized in a manner similar to that of heat recuperator 28 in FIG. 1 to recover excess heat from the annular shaft kiln 110. As previously described, the heat recovered from the kiln may be fed through conduit 136 as a preheat gas for each of the fluid bed air heaters 140 and 140'.

It can thus be seen that the invention may utilize a coarse solid fuel to supply the heat requirements of an annular shaft kiln or double inclined shaft kiln without the attendant disadvantages of the prior art.

The invention is shown and described in preferred form and by way of example and many modifications and variations may be made therein within the scope of the invention. The invention, therefore, is not intended to be limited to any specific form or embodiment, except insofar as such limitations are expressly set forth in the claims.

We claim:

1. In an annular shaft kiln for the burning of limestone or the like, comprising:

a generally vertical hollow structure having an inlet at an upper end thereof and a discharge site at the lower end thereof;

an enclosed shaft connecting said inlet and said discharge site;

an inner cylinder disposed within said generally vertical shaft so as to define a generally annular zone between said inlet and said discharge site, and further comprising at least one chamber in said annular zone for the introduction of hot gases to said zone;

a heat recuperator for recovering excess heat from said shaft kiln;

the improvement comprising a fluidized bed air heater for supplying said hot gases to be injected into each of said chambers;

said fluized bed comprising an inert bed of fluidized material;

means for supplying solid fuel to said fluidized bed for combustion therein to produce hot gases;

an outlet for hot gases;

conduits connecting said outlet for hot gases to said at least one chamber; and means to introduce excess heat received by said heat recuperator to said fluid bed air heater.

2. The shaft kiln of claim 1, wherein said at least one chamber comprises two chambers and said kiln further comprises two fluidized bed air heaters each for supplying said hot gases to one of said chambers.

3. The annular shaft kiln of claim 2, further comprising means for introducing solid, liquid or gaseous fuel directly into each of said chambers.

4. In an apparatus for burning limestone, dolomite, magnesite and ores or the like comprising:

a generally vertical hollow structure having an inlet for material to be burned at the upper end thereof and a discharge site at the lower end thereof for discharging burned material;

a substantially enclosed shaft connecting said inlet and said discharge site;

means defining at least one chamber in said shaft for the introduction of hot gases to said shaft for burning the material therein;

a fluidized bed air heater for producing hot gases;

conduit means for supplying hot gases from said air heater to said at least one chamber;

a heat recuperator for recovering excess heat from the shaft; and means for supplying the excess heat recovered by said heat recuperator to said fluidized bed air heater.

5. In an apparatus for burning limestone, dolomite, magnesite and ores or the like according to claim 4 wherein there are two chambers in said shaft and two fluidized bed air heaters, each flow connected by said conduit means to one of said chambers.

* * * * *